US005495844A

United States Patent [19]

Kitajima et al.

[11] Patent Number: 5,495,844

[45] Date of Patent: Mar. 5, 1996

[54] SEGMENTAL GRINDING WHEEL

[75] Inventors: Masato Kitajima, Hekinan; Hajime Fukami, Oobu; Shinji Soma, Handa; Koji Nishi, Kariya; Masahiro Yoshida, Nishikasugai, all of Japan

[73] Assignee: Toyoda Koki Kabushiki Kaisha, Kariya, Japan

[21] Appl. No.: 286,228

[22] Filed: Aug. 5, 1994

Related U.S. Application Data

[63] Continuation of Ser. No. 971,479, Nov. 4, 1992, abandoned.

[30] Foreign Application Priority Data

Nov. 6, 1991 [JP] Japan ..... 3-090831 U

[51] Int. Cl.[6] ..... B28D 1/04; B28D 1/12

[52] U.S. Cl. ..... 125/13.01; 125/15; 451/541; 451/544; 451/547

[58] Field of Search ..... 125/13.01, 15, 125/22; 451/540, 541, 544, 547

[56] References Cited

U.S. PATENT DOCUMENTS

| | | | |
|---|---|---|---|
| 1,699,746 | 1/1929 | McKay | 125/15 |
| 1,866,356 | 7/1932 | Jones | 125/22 |
| 1,939,991 | 12/1933 | Krusell | 125/22 |
| 2,006,308 | 6/1935 | Bush et al. . | |
| 3,271,911 | 9/1966 | McKenna | 125/15 |
| 3,553,905 | 1/1971 | Lemelson | 125/15 |
| 4,016,857 | 4/1977 | Hall | 125/18 |
| 4,067,311 | 1/1978 | Benetello | 451/41 |
| 4,407,263 | 10/1983 | Murata | 125/15 |
| 4,677,963 | 7/1987 | Ajamian | 125/15 |
| 5,079,875 | 1/1992 | Unno et al. . | |

FOREIGN PATENT DOCUMENTS

| | | |
|---|---|---|
| 0433692 | 6/1991 | European Pat. Off. . |
| 58-160764 | 10/1983 | Japan . |
| 61-9258 | 1/1986 | Japan . |

*Primary Examiner*—Maurina T. Rachuba
*Attorney, Agent, or Firm*—Oblon, Spivak, McClelland, Maier & Neustadt

[57] ABSTRACT

In a grinding wheel for use in a grinding machine, a plurality of grinding tips are bonded on the outer peripheral surface of a wheel core having a disk-like shape by bond. On both side surfaces of the wheel core are formed with depressions continuous with the outer peripheral surface of the wheel core. Bond is filled between the outer peripheral surface and the grinding chips, and filled in the depressions of the wheel core to form a bonding layer. Namely, the bonding layer has side portions which extends along both side surfaces of the wheel core in a radial direction.

7 Claims, 5 Drawing Sheets

SEGMENTAL GRINDING WHEEL

This application is a continuation of application Ser. No. 07/971,479, filed on Nov. 4, 1992, now abandoned.

BACKGROUND OF THE INVENTION

1. Field of the Invention

The present invention relates to a segmental grinding wheel which is used in a grinding machine and the like.

2. Discussion of the Prior Art

Conventionally, a segmental grinding wheel is composed of a circular wheel core and a plurality of segmented grinding tips bonded on the peripheral surface of the wheel core through a bonding layer. Also, every two adjacent grinding tips are bonded to each other using bond.

When the segmental grinding wheel is rotated at a high speed, a large centrifugal force acts on the grinding chips. Therefore, the bonding strength between the wheel core and the grinding chips is very important in cases where the grinding wheel is rotated at a very high speed.

Further, since water-soluble epoxy resin is used as the bond in such segmental grinding wheel, the bonding layer thereof is gradually swelled by coolant during grinding operation, whereby the bonding strength of the bonding layer decreases gradually.

As a result, there is a limit on the rotational speed of the grinding wheel. Further, there is a problem that the service life of the grinding wheel becomes short due to the swelling of the bonding layer.

SUMMARY OF THE INVENTION

Accordingly, it is an object of the present invention to provide an improved segmental grinding wheel whose bonding layer has a bonding strength larger than conventional one.

It is another object of the present invention to provide an improved segmental grinding wheel which can be used for a longer period of time as composed with conventional one even if the bonding layer is swelled by coolant.

Briefly, the improved segmental grinding wheel according to the present invention comprises a wheel core having a disk-like shape, a plurality of segmented grinding chips disposed on the periphery of the wheel core, and a bonding layer filled between the wheel core and the grinding chips for bonding the grinding chips to the wheel core. The bonding layer has a pair of side portions which extend along respective side surfaces of the grinding wheel in a radial direction.

With this configuration, the bonding strength of the bonding layer is increased by the increment of the bonding area. Further, since the bonding layer extends along both the side surfaces of the wheel core, it is prevented that the coolant invades to the outer periphery portion of the wheel core. Accordingly, the grinding chips do not drop from the wheel core even when the grinding wheel is rotated at a high speed.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

The preferred embodiments of the present invention will now be described with reference to drawings.

Figure 1:
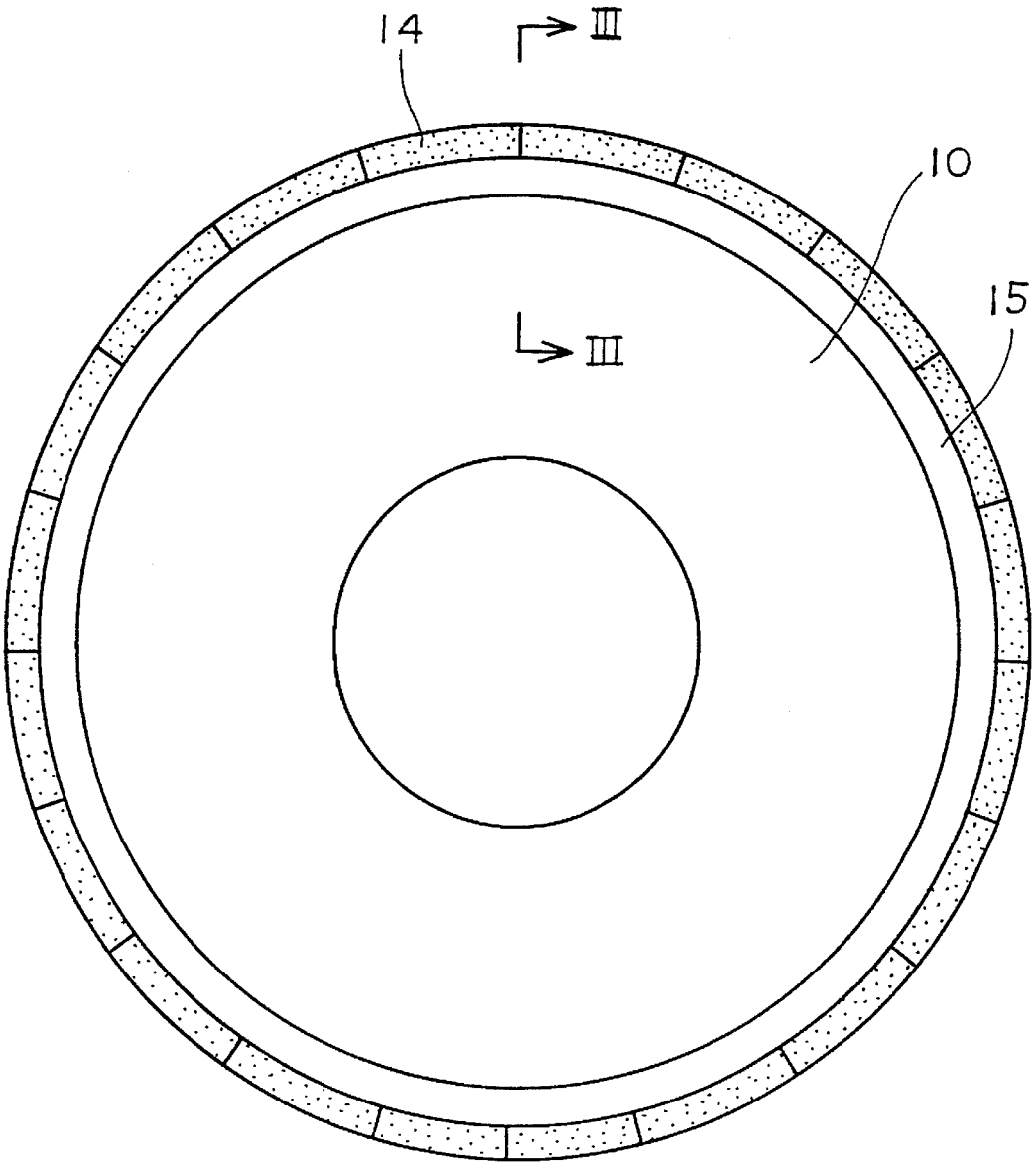
FIG. 1 is a side view of a segmental grinding wheel according to a first embodiment of the present invention.
Figure 2:
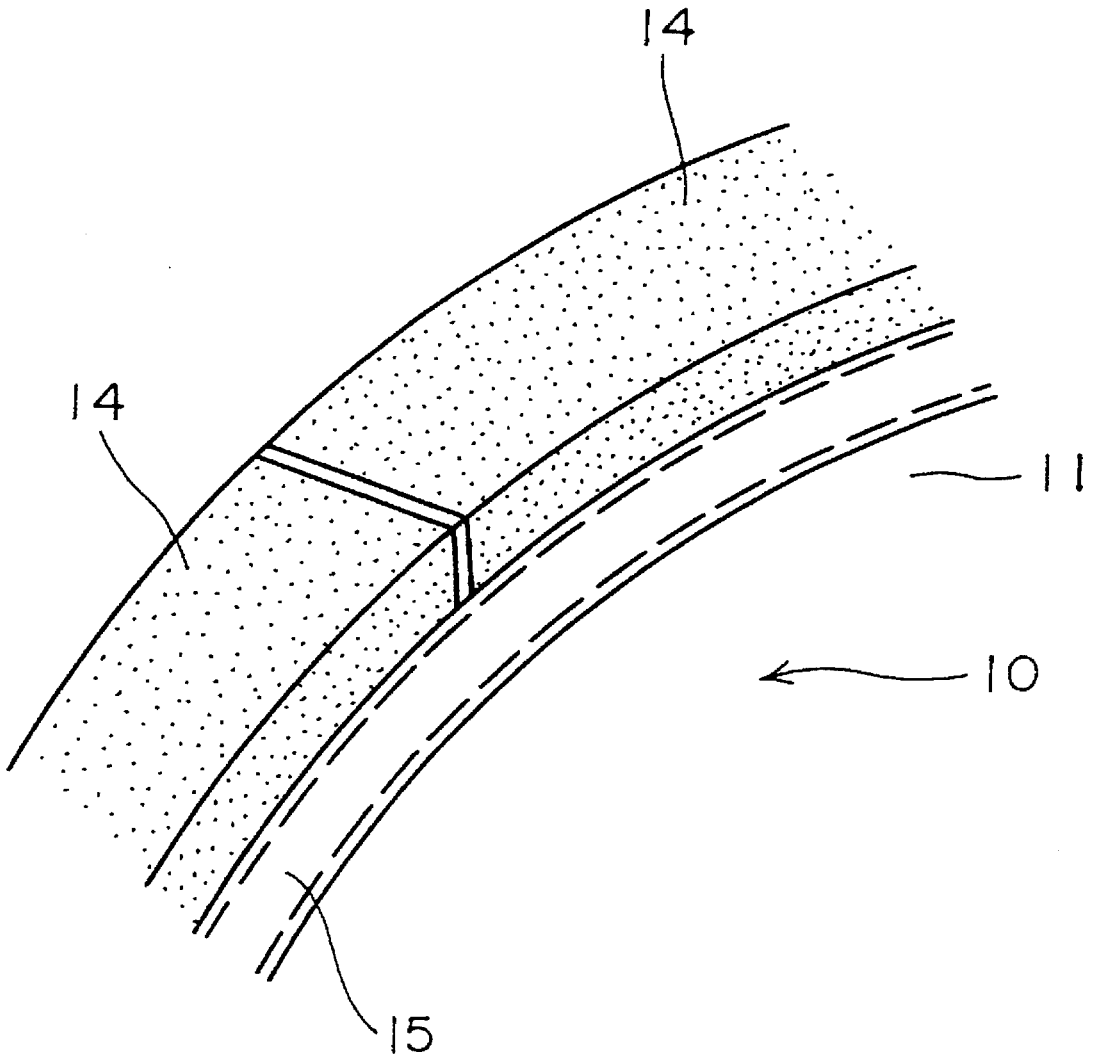
FIG. 2 is a perspective view of the segmental grinding wheel according to the first embodiment 1.
Figure 3:
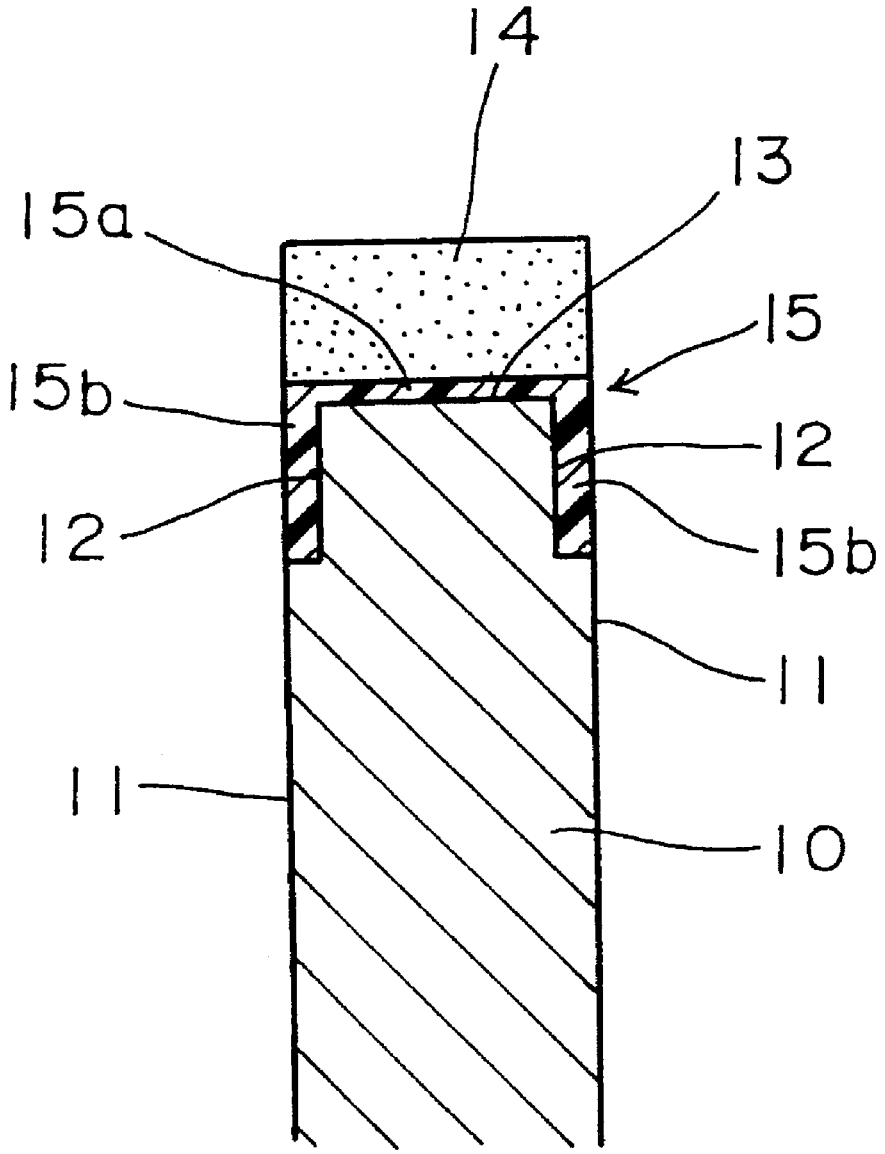
FIG. 3 is a sectional view taken on line 111—111 of FIG. 1.

Referring now to FIG. 1 to FIG. 3 showing the first embodiment of the present invention, numeral 10 designates a circular wheel core made of metal such as steel. On both side surfaces 11 of the wheel core 10 are formed depressions 12 continuous with an outer peripheral surface 13 of the wheel core 10. The depth of the depressions 12 in a direction parallel to the center axis of the wheel core 10 is a few millimeters, and the width of the depressions 12 in the radial direction is about 10 millimeters. Bond is applied to the outer peripheral surface 13 and the depressions 12, and a plurality of segmented grinding chips 14 are bonded on the outer peripheral surface 13 side by side in the circumferential direction so that a bonding layer 15 is formed between the outer peripheral surface 13 and the grinding chips 14. Also, every two adjacent grinding chips 14 are bonded to each other by the bond. The grinding chips 14 are made of super-hard abrasive grains such as CBN abrasive grains.

In this way, the grinding chips 14 are bonded to the wheel core 10 through the bonding layer 15 which is composed of a cylindrical portion 15*a* formed on the outer peripheral surface 13 of the wheel core 10 and side portions 15*b* formed at the depressions 12 which are continuous with the cylindrical portion 15*a*, as shown in FIG. 3.

The radius and the thickness of the wheel core 10 are about 195 and 10 millimeters, respectively. The side portions 15*b* at the depressions 12 have a width of about 10 millimeters in the radial direction. Here, the bond using for the bonding layer 15 is made of water-soluble epoxy resin. The side portions 15*b* has a width of at least 3 millimeters in the radial direction, and is formed continuously in the circumferential direction. The width of the side portions 15*b* may be wider to increase the contact area thereof. Further, the side portions 15*b* may be formed to be split in the circumferential direction of the wheel core 10. Since the depressions 12 are used as spaces in which a constant amount of bond is filled, it is possible to make the width of the bonding layer 15 constant. Therefore, segmental grinding wheels having a constant bonding strength can be manufactured.

Figure 4:
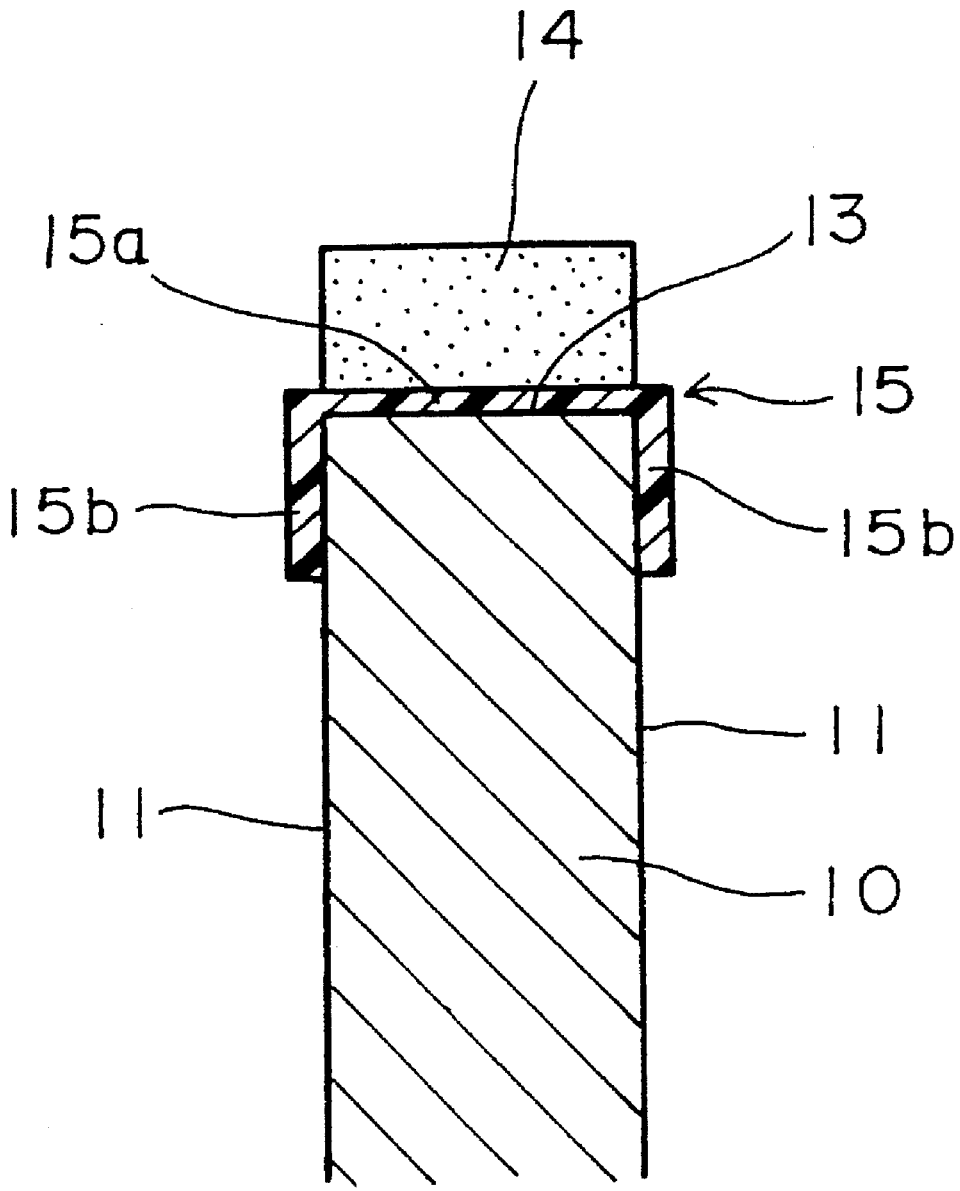
FIG. 4 is a sectional view of a segmental grinding wheel according to a second embodiment of the present invention.

FIG. 4 illustrates a sectional view of a segmental grinding wheel according to the second embodiment of the present invention. In this embodiment, bond is filled between the outer peripheral surface 13 and the grinding chips 14, and applied to both the side surfaces 11 of the wheel core 10 directly without forming the depressions 12.

Figure 5:
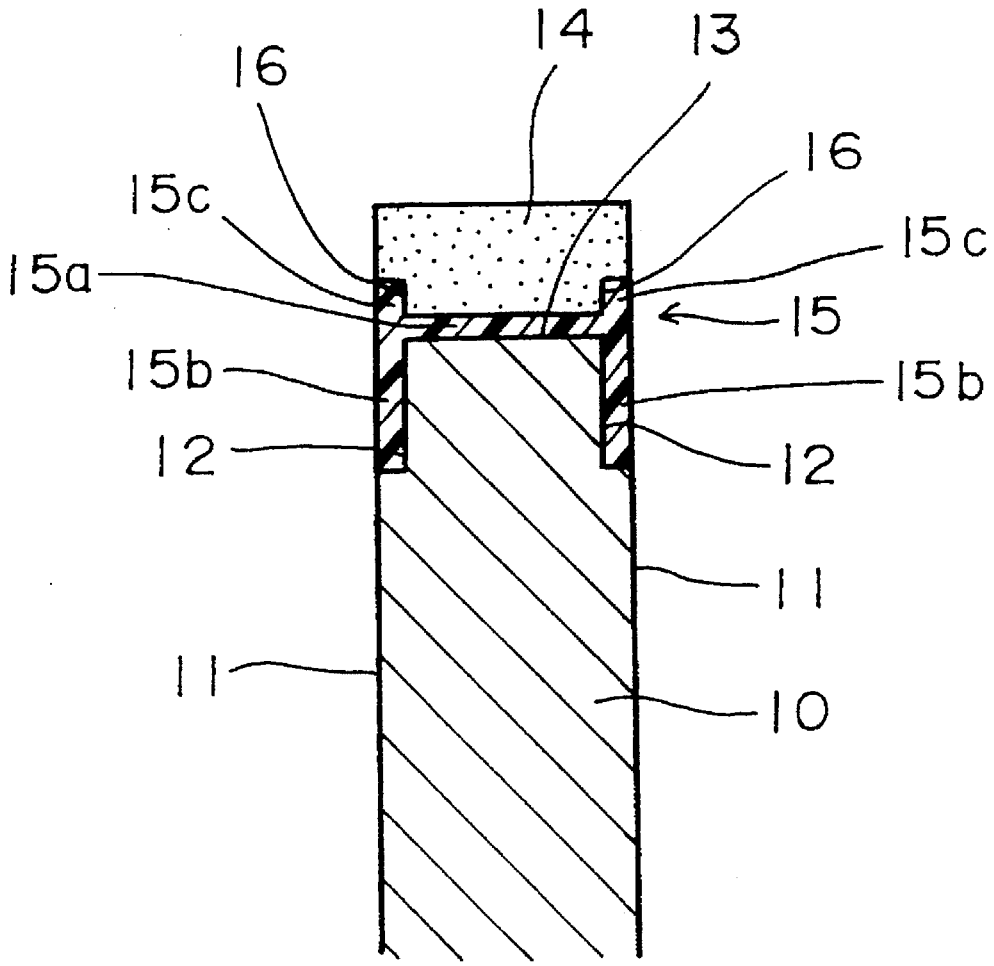
FIG. 5 is a sectional view of a segmental grinding wheel according to a third embodiment of the present invention.

FIG. 5 illustrates a sectional view of a segmental grinding wheel according to the third embodiment of the present invention. In this embodiment, the grinding chips 14 are also formed with depressions 16. Bond is filled in the depressions 16 to form a side portions 15*c*. Namely, the bonding layer 15 is composed of the cylindrical portion 15*a* formed between the outer peripheral surface 13 of the wheel core 10 and the grinding chips 14, the first side portions 15*b* formed at the depressions 12 of the wheel core 10 and the second side portions 15*c* formed at the depressions 16 of the grinding chips 14.

By constituting the bonding layer 15 as described above, the bonding strength of the bonding layer 15 increases because of the increment of the bonding area. As a result, the grinding chips 14 do not drop from the wheel core 10 even when the grinding wheel is rotated at a high speed. Further, it can be prevented that the coolant invades between the outer peripheral surface 13 of the wheel core 10 and the bonding layer 15. Therefore, it is possible to keep the bonding strength of the bonding layer 15 higher than a desired level for a longer period of time as compared with the conventional segmental grinding wheel.

Obviously, numerous modifications and variations of the present invention are possible in light of the above teachings. It is therefore to be understood that within the scope of the appended claims, the present invention may be practiced otherwise than as specifically described herein.

What is claimed is:

1. A segmental grinding wheel for use in a grinding machine, said grinding wheel comprising:

a wheel core having a disk-like shape, including a radially outer peripheral surface;

a plurality of segmented grinding chips forming abrasive teeth or segments spaced about the radially outer peripheral surface of the wheel core and disposed on the radially outer peripheral surface of said wheel core; and a bonding layer on the radially outer peripheral surface and filled between said wheel core and said grinding chips for bonding said grinding chips to said wheel core;

wherein said bonding layer has a pair of side portions which extend along respective side surfaces of said grinding wheel in a radial direction.

2. A segmental grinding wheel as set forth in claim 1, wherein:

said side portions of said bonding layer extend toward the center of said wheel core from the periphery of said wheel core.

3. A segmental grinding wheel as set forth in claim 2, wherein:

each side surface of said wheel core is formed with a depression at the peripheral edge thereof, and each of said side portions of said bonding layer is formed by a bond filled in said depression.

4. A segmental grinding wheel as set forth in claim 1, wherein at least a portion of said side portion of said bonding layer is not covered by said grinding chips.

5. A segmental grinding wheel as set forth in claim 1, wherein said grinding chips are disposed only on the cylindrical peripheral surface of the wheel core.

6. A segmental grinding wheel for use in a grinding machine, said grinding wheel comprising:

a wheel core having a disk-like shape;

a plurality of segmented grinding chips forming abrasive teeth or segments spaced about the periphery of the wheel core and disposed on the periphery of said wheel core;

a bonding layer filled between said wheel core and said grinding chips for bonding said grinding chips to said wheel core;

wherein said bonding layer has a pair of side portions which extend along respective side surfaces of said grinding wheel in a radial direction; and wherein said side portions are composed of first portions extending toward the center of said wheel core along the side surfaces of said wheel core and second portions extending outward in the radial direction along the side surfaces of said grinding chips.

7. A segmental grinding wheel for use in a grinding machine, said grinding wheel comprising:

a wheel core having a disk-like shape;

a plurality of segmented grinding chips forming abrasive teeth or segments spaced about the periphery of the wheel core and disposed on the periphery of said wheel core;

a bonding layer filled between said wheel core and said grinding chips for bonding said grinding chips to said wheel core;

wherein said bonding layer has a pair of side portions which extend along respective side surfaces of said grinding wheel in a radial direction; and wherein each side surface of said wheel core is formed with a first depression at the peripheral edge thereof, each of said first portions of said side portions is formed by a bond filled in said first depression, each side surface of each grinding chip is formed with a second depression at the inner edge thereof, and each of said second portions of said side portions is formed by a bond filled in said second depression.

* * * * *